US008464489B2

(12) United States Patent
Pervan et al.

(10) Patent No.: US 8,464,489 B2
(45) **Date of Patent: *Jun. 18, 2013**

(54) LAMINATE FLOOR PANELS

(75) Inventors: Darko Pervan, Viken (SE); Christian Boo, Kagerod (SE); Mattias Sjostrand, Helsingborg (SE)

(73) Assignee: Valinge Innovation AB, Viken (SE)

( * ) Notice: Subject to any disclaimer, the term of this patent is extended or adjusted under 35 U.S.C. 154(b) by 724 days.

This patent is subject to a terminal disclaimer.

(21) Appl. No.: 11/635,674

(22) Filed: Dec. 8, 2006

(65) Prior Publication Data

US 2007/0175156 A1 Aug. 2, 2007

Related U.S. Application Data

(60) Provisional application No. 60/758,209, filed on Jan. 12, 2006.

(30) Foreign Application Priority Data

Jan. 12, 2006 (SE) ..... 0600061

(51) Int. Cl.
*E04B 2/00* (2006.01)

(52) U.S. Cl.
USPC ..... 52/591.1; 52/590.2; 52/589.1; 52/592.1; 52/592.2

(58) Field of Classification Search
USPC ..... 52/391, 392, 311.2, 585.1, 590.2, 52/589.1, 591.1, 591.5, 592.1, 592.2
See application file for complete search history.

(56) References Cited

U.S. PATENT DOCUMENTS

| | | | | |
|---|---|---|---|---|
| 2,057,135 | A | | 10/1936 | Cherry |
| 2,497,837 | A | | 2/1950 | Nelson |
| 2,740,167 | A | | 4/1956 | Rowley |
| 2,914,815 | A | | 12/1959 | Cook |
| 3,200,553 | A | * | 8/1965 | Frashour et al. ..... 52/592.4 |
| 3,347,048 | A | * | 10/1967 | Brown et al. ..... 405/16 |
| 4,426,820 | A | | 1/1984 | Terbrack |
| 5,425,986 | A | | 6/1995 | Guyette |
| 5,560,569 | A | | 10/1996 | Schmidt |
| 5,744,220 | A | | 4/1998 | Ringö |
| 5,899,251 | A | | 5/1999 | Turner |
| 5,985,398 | A | | 11/1999 | Bellegarde |

(Continued)

FOREIGN PATENT DOCUMENTS

| | | | |
|---|---|---|---|
| CN | 2056173 | U | 4/1990 |
| CN | 2236517 | Y | 10/1996 |

(Continued)

OTHER PUBLICATIONS

International Search Report issued in PCT/SE2006/001404 (Published as WO 2007/081256 A1), Mar. 1, 2007, Swedish Patent Office, Stockholm, SE.

(Continued)

*Primary Examiner* — Joshua J Michener
*Assistant Examiner* — Chi Q Nguyen
(74) *Attorney, Agent, or Firm* — Buchanan Ingersoll & Rooney P.C.

(57) ABSTRACT

Floor panels are shown with discontinuous surface layers, which are mechanically connectable to each other along one pair of adjacent edges, said floor panels comprising at least two floor elements whereof at least one of the floor elements is non rectangular.

32 Claims, 5 Drawing Sheets

U.S. PATENT DOCUMENTS

| | | | |
|---|---|---|---|
| 6,189,283 | B1 | 2/2001 | Bentley |
| 6,421,970 | B1 | 7/2002 | Martensson |
| 6,536,178 | B1 | 3/2003 | Pålsson et al. |
| 6,647,690 | B1 | 11/2003 | Martensson |
| 6,729,091 | B1 | 5/2004 | Martensson |
| 6,763,643 | B1 | 7/2004 | Martensson |
| 6,769,218 | B2 | 8/2004 | Pervan |
| 2004/0045254 | A1 | 3/2004 | Van Der Heijden |
| 2004/0139678 | A1 | 7/2004 | Pervan |
| 2007/0175143 | A1 | 8/2007 | Pervan |
| 2008/0005989 | A1 | 1/2008 | Pervan |
| 2008/0005997 | A1 | 1/2008 | Pervan |
| 2008/0005998 | A1 | 1/2008 | Pervan |
| 2008/0041007 | A1 | 2/2008 | Pervan |
| 2008/0168736 | A1 | 7/2008 | Pervan |
| 2008/0209837 | A1 | 9/2008 | Pervan |
| 2008/0209838 | A1 | 9/2008 | Pervan |

FOREIGN PATENT DOCUMENTS

| | | | |
|---|---|---|---|
| CN | 1646778 | A | 7/2005 |
| DE | 2 159 042 | A1 | 6/1973 |
| DE | 33 43 601 | A1 | 6/1985 |
| DE | 296 18 318 | U1 | 5/1997 |
| DE | 197 18 319 | A1 | 11/1998 |
| DE | 197 18 812 | A1 | 11/1998 |
| DE | 199 51 771 | A1 | 6/2001 |
| FR | 1 179 730 | A | 5/1959 |
| FR | 2 690 650 | A1 | 11/1993 |
| JP | 7-300979 | A | 11/1995 |
| WO | WO 97/47834 | A1 | 12/1997 |
| WO | WO 00/20705 | A1 | 4/2000 |
| WO | WO 00/66856 | A1 | 11/2000 |
| WO | WO 01/66877 | A1 | 9/2001 |
| WO | WO 02/055809 | A1 | 10/2001 |
| WO | WO 02/055810 | A1 | 7/2002 |
| WO | WO 03/025307 | A1 | 3/2003 |
| WO | WO 03/089736 | A1 | 10/2003 |

OTHER PUBLICATIONS

International Preliminary Report on Patentability issued in PCT/SE2006/001404 (Published as WO 2007/081256 A1), Jul. 15, 2008, The IB of WIPO, Geneva, CH.

Written Opinion issued in PCT/SE2006/001404 (Published as WO 2007/081256 A1), Mar. 1, 2007, ISA/SE—Patent-och registreringsverket, Stockholm, SE.

* cited by examiner

LAMINATE FLOOR PANELS

BENEFIT

The present application claims the benefit of U.S. Provisional Application No. 60/758,209, filed in the United States on Jan. 12, 2006, the entire contents of which are hereby incorporated herein by reference.

TECHNICAL FIELD

The invention generally relates to the field of flooring systems and laminated floor panels, which could be installed in advanced patterns, especially such floor panels which are possible to lock and unlock with mechanical locking systems. The invention concerns an improvement of the flooring system and floor panels described in WO 03/089736

FIELD OF APPLICATION

Embodiments of the present invention are particularly suitable for use in floating floors, which are not attached to the sub floor and which are formed of floor panels joined mechanically with a locking system integrated with the floor panel, i.e. mounted at the factory, are made up of one or more upper layers of printed and structured materials such as decorative laminate or decorative plastic material, an intermediate core of wood fibre based material or plastic material and preferably a lower balancing layer on the rear side of the core. The following description of known techniques, problems of known systems and objects and features of embodiments of the invention will therefore, as a non restrictive example, be aimed above all at this field of application and in particular laminate flooring.

It should be emphasised that embodiments of the invention can be used in any floor panel and it could be combined with all types of known locking system, where the floor panels are intended to be joined using a mechanical locking system connecting the panels in the horizontal and vertical directions on at least two adjacent sides. The invention can thus also be applicable to, for instance, solid wooden floors, parquet floors with a core of wood or wood fibre based material and a surface of wood or wood veneer and the like, floors with a printed and preferably also varnished surface, floors with a surface layer of plastic or cork, linoleum, rubber or similar. Even floors with hard surfaces such as stone, tile and similar are included and floorings with soft wear layer, for instance needle felt glued to a board. The principle could also be used on floors which are glued or nailed to the subfloor.

BACKGROUND

Laminate flooring usually comprises rectangular floor panels with a core of a 6-12 mm fibreboard, a 0.2-0.8 mm thick upper decorative surface layer of laminate and a 0.1-0.6 mm thick lower balancing layer of laminate, plastic, paper or like material. A laminate surface may comprise a printed melamine impregnated paper, which is pressed with an embossed sheet. The most common core material is fibreboard with high density and good stability usually called HDF—High Density Fibreboard. Sometimes also MDF—Medium Density Fibreboard—is used as core.

Traditional laminate floor panels of this type have taken a large market share mainly due to the fact that advanced printing and pressing technology has made it possible to make very natural copies of mainly wood parquet floorings. Laminate floorings look like wood, but are more durable and less expensive than wood floorings.

In addition to such traditional floors, which have been installed with a tongue and groove joint and with glue, floor panels have been developed which do not require the use of glue and instead are joined mechanically by means of so called mechanical locking systems.

These systems comprise locking means, which lock the panels horizontally and vertically. The mechanical locking systems are usually formed by machining of the core of the panel. Alternatively, parts of the locking system can be formed of a separate material, for instance aluminium or HDF, which is integrated with the floor panel, i.e. joined with the floor panel in connection with the manufacture thereof.

The main advantages of floating floors with mechanical locking systems are that they are easy to install. They can also easily be taken up again and used once more at a different location.

DEFINITION OF SOME TERMS

By "horizontal plane" or "principal plane" is meant a plane, which extends parallel to the outer part of the surface layer. Immediately juxtaposed upper parts of two adjacent joint edges of two joined floor panels together define a "vertical plane (V)" perpendicular to the horizontal plane. By "horizontally" is meant parallel to the horizontal plane and by "vertically" parallel to the vertical plane By "locking systems" are meant co-acting connecting means, which connect the floor panels vertically and/or horizontally. By "mechanical locking system" is meant that joining can take place without glue.

By a "discontinuous surface layer and core" is meant the surface layer and core of two elements connected to each other to form one panel or two panels connected to each other to form a floor and consequently the core and the surface layer of the elements and the panels respectively is discontinuous. A joint is detectable between the two element or panels at the discontinuity.

PRIOR ART TECHNIQUE AND PROBLEMS THEREOF

Printing and pressing technology have in recent years been developed further and very natural copies of stone, tiles and parquet strips have been introduced on the market.

There are however a lot of designs and patterns which are not possible to produce and install with the present printing, pressing and mechanical locking technology.

Most designs which contain patterns or structures where parts have to be aligned with the format of the floor panel are difficult to produce since swelling and shrinking of the printed paper and the positioning of the printing paper and the press sheet are difficult to control. Joints, which cross a specific pattern, which is design to be one unite, gives an unnatural appearance.

It is known that some advanced patterns could be produced with individual rectangular small floor panels, which could be connected to floor units. Such patterns and floor panels are described in WO 03/08973. This known technology is not suitable for patterns, which aim to copy for example advanced stone and tile floors. U.S. Pat. No. 6,729,091 describes small panels with polygonal shape. These panels are very difficult and costly to produce and time consuming and difficult to install.

OBJECTS AND SUMMARY

A first overall objective of embodiments of the present invention is to provide a flooring system and floor panels, with preferably mechanical locking systems, which could be installed in advanced patterns and where the pattern to a large extent is obtained by the size, shape and mechanical working of the panels and the elements and not only by printing and pressing technology.

More specifically the object is to provide a flooring system and floor panels with mechanical locking system where one or several of the following advantages are obtained.

The floor panel should preferably be possible to assemble mechanically to a floor surface which generally only could be obtained with small individual wood, tile or stone pieces with different sizes or non parallel edges and with panels, which are not floating but glued or nailed to the sub floor The floor panels should be easy to install in spite of the fact that the floor pattern could comprise a lot of small floor panels with different sizes and advanced shapes, which differ from the traditional rectangular panels.

The substantial waste, which is usually required in order to produce floor panels and mechanical locking system in floors comprising small and non rectangular floor panels, should be reduced as much as possible The above objects of embodiments of the invention are achieved wholly or partly by a mechanical locking system and floor panels. Embodiments of the invention are evident from the description and drawings.

According to the invention, a flooring system is provided comprising a plurality of floor panels with a core and a discontinuous surface layer. The floor panels are mechanically connectable to each other along one pair of adjacent edges and each floor panel comprises at least two floor elements whereof at least one of the floor elements is non rectangular.

The floor elements are preferably factory connected to a floor panel and delivered as floor panels preferably in a package to the installation place as parts of a pre installed floor. The connection between floor elements should be such that several floor elements are kept in a pre determined position in relation to each other during installation. This connection could be such that floor elements are permanently connected with for instance glue or mechanical locking system, which keeps the floor elements in a correct position during installation.

A floor panel, which is formed of several individual floor elements, offers a lot of advantages. Patterns could be created which are not possible to produce with printing or linear machining of the edges. Installation is easy since several floor elements could be installed at the same time. The joint between the floor elements could be rather simple and inexpensive but still strong and reliable since the floor elements are connected in the factory where suitable equipment could be used. The floor is to a large extent pre-installed at the factory and the individual elements could be connected to each other in a very efficient way. A lot of time consuming and difficult installation work where the floor installer has to work close to the floor, could be moved to a controlled factory environment.

BRIEF DESCRIPTION OF THE DRAWINGS

FIGS. 1*a*-4*b* illustrate known locking systems.

FIGS. 4*c*-5 illustrate a first embodiment of the invention.

DESCRIPTION OF EMBODIMENTS OF THE INVENTION

To facilitate understanding, several floor panels and locking systems in the figures are shown schematically. It should be emphasised that improved or different functions can be achieved using combinations of the preferred embodiments. Known locking systems which have one or more tongues and grooves or locking elements cooperating with locking grooves could be used to connect floor elements to a floor panel and to connect the floor panels to a floor.

Angles, dimensions, rounded parts, etc. are only examples and could be adjusted within the principles of embodiments of the invention.

Figure 1A:
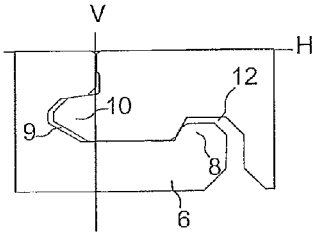
Fig. 1a PRIOR ART
Figure 1B:
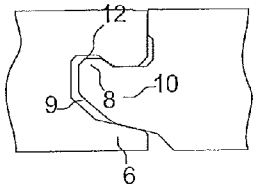
Fig. 1b PRIOR ART
Figure 1C:
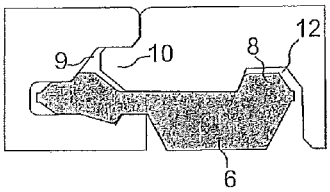
Fig. 1c PRIOR ART

FIGS. 1*a*-1*c* show known mechanical locking systems, which could be locked with angling and/or snapping. These locking systems have a tongue 10 and a grove 9 for vertical locking of adjacent edges parallel to the vertical plane V and a locking grove 12 and a locking element 8 for horizontal locking parallel with the horizontal plane H. The locking element could be located on a tongue 10 or a strip 6.

Figure 2A:
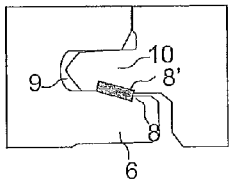
Fig. 2a PRIOR ART
Figure 2B:
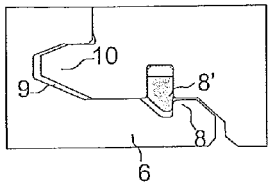
Fig. 2b PRIOR ART
Figure 2C:
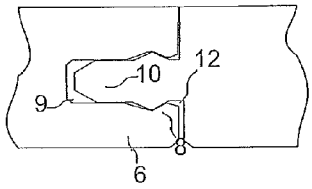
Fig. 2c PRIOR ART

FIGS. 2*a*-2*c* show mechanical locking systems, which could be locked by horizontal snapping. The locking elements could be made in one piece with the core as in FIG. 2*c* or of a separate material, hereafter referred to as two piece snap, as in FIGS. 2*a* and 2*b*. These snap systems have a low snapping resistance and a high locking strength and are therefore very suitable to use in floor panels according to the invention.

Figure 3A:
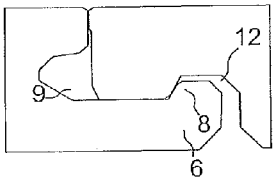
Fig.3a PRIOR ART
Figure 3B:
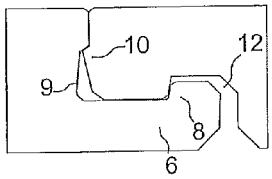
Fig. 3b PRIOR ART
Figure 3C:
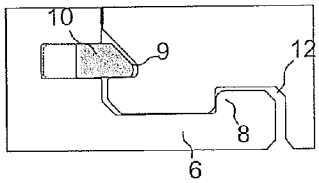
Fig. 3c PRIOR ART

FIG. 3*a*-3*c* show mechanical locking systems which could be locked by a vertical folding. Such systems could have means for horizontal locking only, as in FIG. 3*a*, hereafter referred to as vertical hook systems or they could have a small tongue 10 made in one piece, as in FIG. 3*b*, hereafter referred to as vertical tongue systems. Alternative the tongue 10 could be flexible as in FIG. 3*c*. Such vertical folding with a tongue, which is displaceable horizontally, is very suitable to use in the floor panels according to the invention. Such systems are referred to a flex tongue systems.

Figure 4A:
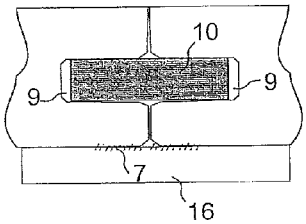
Fig. 4a PRIOR ART
Figure 4B:
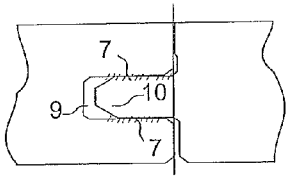
Fig. 4b PRIOR ART
Figure 4C:
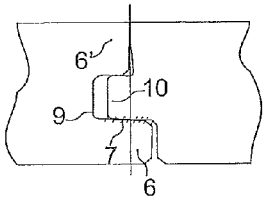

FIG. 4*a*-4*b* show traditional locking systems, which are locked vertically with a tongue 10 and a grove 9 and horizontally with glue 7. FIG. 4*c* show how a tongue and groove joint could be adjusted to be used in a factory connection of floor elements. The tongue 10 has been made smaller since special glue with controlled equipment could be used. The under lip 6 has been made slightly longer and extends beyond the upper lip 6'. This simplifies the application of glue and the under lip 6 could be formed such that it creates a vertical pre tension and keeps the floor element together until the glue cures.

Figure 5:
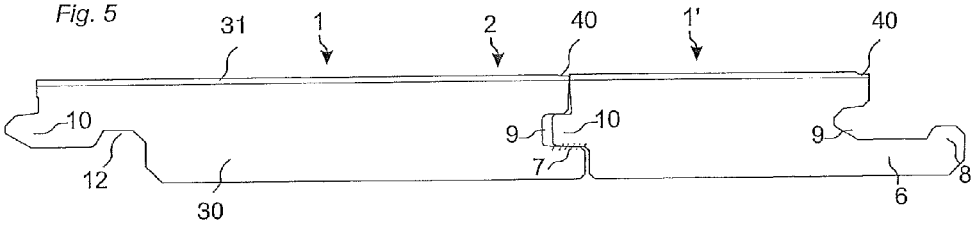

FIG. 5 illustrates schematically a cross section of a floor panel 2, which comprises two separate floor elements 1, 1', which have been factory connected with a tongue and groove locking system. The floor panel 2 has a surface layer 31 and a core 30, which are discontinuous, and edges, which in this preferred embodiment could be locked with angling. The floor elements preferably have a decorative groove 40, bevel or similar on one edge. When floor elements are connected to floor panels very advance grove patterns could be obtained which are not possible to produce in a cost efficient way if they are to be made in an individual traditional floor panel.

All these locking systems could be used in various combinations to connect floor elements 1, 1' or two or several adjacent edges of floor panels. Mechanical locking systems could be adjusted to lock for example floor elements with a simple snapping which only holds the panels together until the glue cures. Preferred embodiments to lock floor elements are locking systems using glue, since the panels could easily be positioned correctly horizontally to each other in the factory. Floor elements could also be connected with tape on the rear side or glued to a underlay 16 which could be a foam, a cork layer, various types of plastic materials, wood based sheet materials or wood veneer or similar.

Figure 6A:
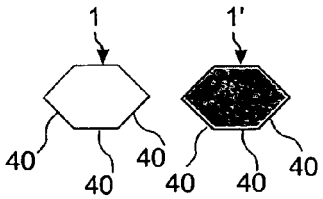
FIGS. 6*a*-9*d* illustrate embodiments of the invention.
Figure 6B:
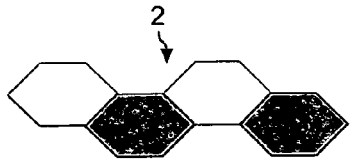
Figure 6C:
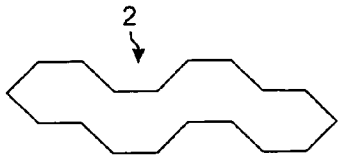

FIG. 6*a* shows two non rectangular floor elements 1, 1', which are connected to a floor element 2 as shown in FIG. 6*b*. The floor elements could have a surface of the same material, for example laminate, but they could also have a surface layers of different materials for example laminate-wood, plastic material-laminate, cork-wood etc. More than two different materials could be combined. The floor elements have decorative grooves 40 on three edges. An advanced floor panel with decorative groves, which in this embodiment meet each other at an angle different than 90 degree, could be produced with linear machining.

Figure 6D:
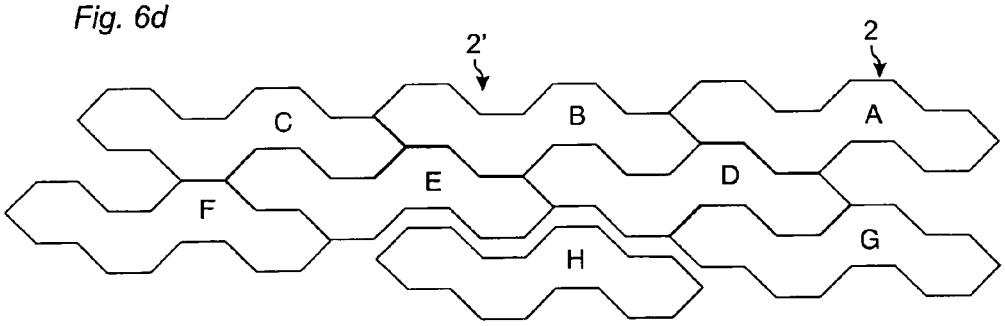

FIG. 6*d* show how floor panels 2 could be installed in the order of A-H with combinations of angling, snapping and vertical folding. Rather simple locking systems could be used since the irregular shape of the panels could be used to prevent displacement along the length direction of the panels.

Figure 6E:
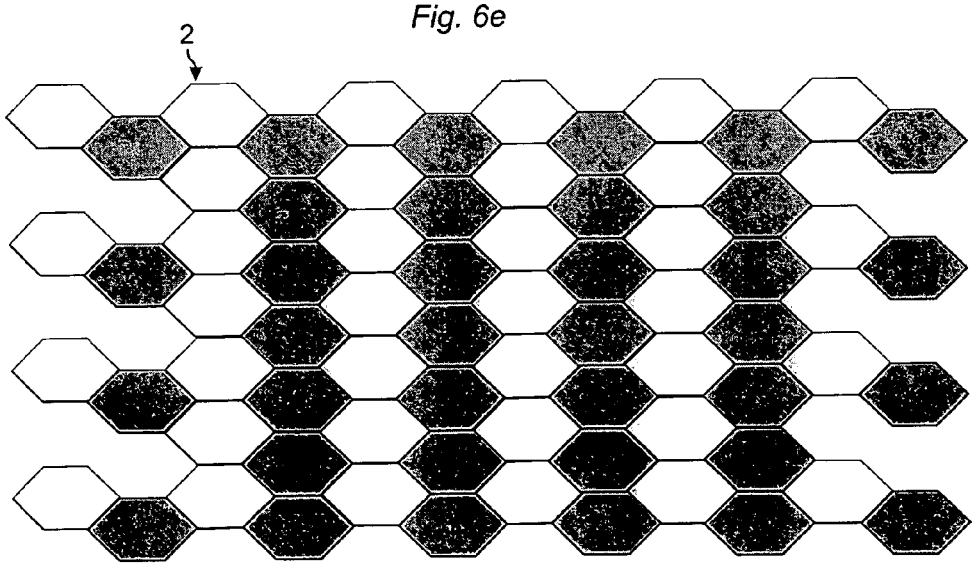

FIG. 6*e* shows a floor with an advanced pattern according to the invention. Such a floor could be installed just as easy as traditional rectangular floor panels. It is obvious that 6, 8 or more floor elements could be connected to a floor panel. Start and end pieces with straight edges could be supplied.

It is also obvious that all embodiments could be used to provide a floor where the floor panels are made of a single floor element. Practical testing shows however that a floor panel comprising four floor elements could be installed in advanced or complex patterns, e.g., different sizes of floor elements, more than four times faster than if the floor was installed with floor panels comprising only one floor element.

Figure 7A:
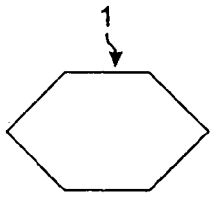
Figure 7B:
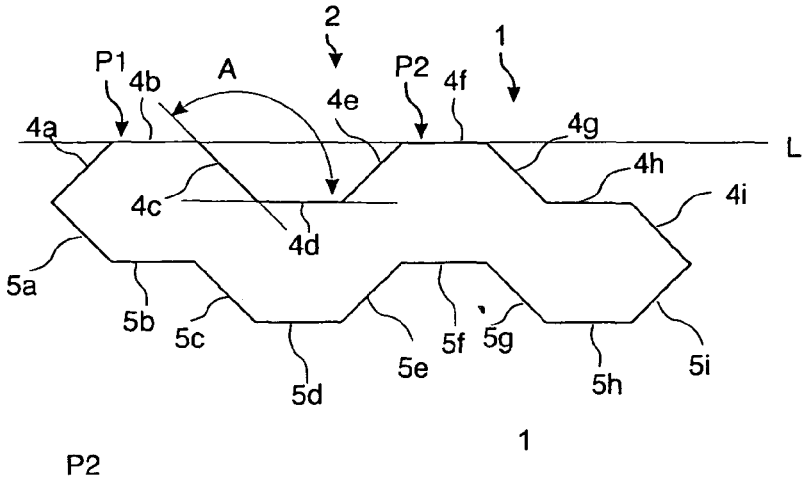
Figure 7C:
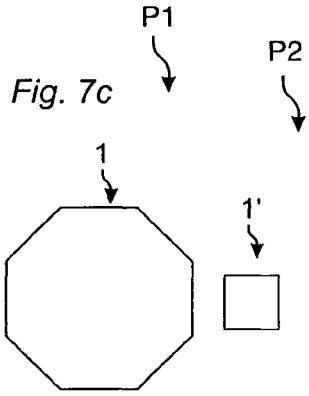

FIG. 7*a* shows a floor element 1 which is used to form a floor panel 2 similar to the floor panel in FIG. 6. The floor panel 2 has 9 pairs (4*a*-4*i* and 5*a*-5*i*) of edges. The floor panel 2 comprises 6 pairs (4*c*-*d* 4*d*-*e*, 4*g*-*h*, 5*b*-*c*, 5*e*-*f* and 5*f*-*g*) of adjacent edges, which are inclined with an angle (A) of more than 90 degrees.

The panels could be locked in several ways. The parallel edges (4*b*-5*b*, 4*d*-5*d*, 4*f*-5*f*, and 4*h*-5*h* could for example have a one or a two piece snap system and the other edges could have a traditional tongue and groove system. Alternatively all edges could be locked with horizontal snapping.

Two pairs of adjacent edges (4*b*-5*b* and 4*f*-5*f*) could have an angling system and two pairs (4*d*-5*d* and 4*h*-5*h*) could have a flex tongue system. All other edges could have a vertical hook system or a vertical tongue system or a flex tongue system or any other system that allows vertical folding.

The floor panel comprises two protrusions (P1, P2) with straight edges, which are positioned along a straight line L. Such protrusions will block mutual displacement of connected panels. The straight edges 4*b*, 4*f* of these protrusions could have a mechanical locking system, which could be locked with angling to opposite parallel edges 5*b*, 5*f* of a similar panel. The other edges could be locked with vertical folding.

Figure 7D:
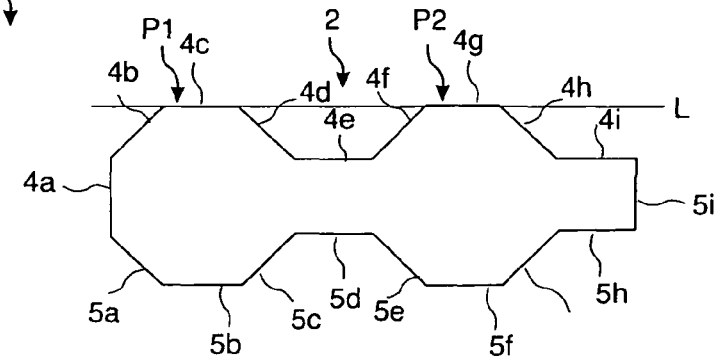
Figure 7E:
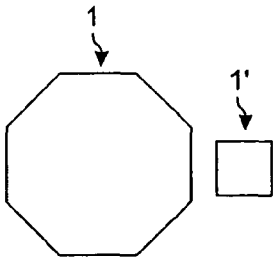
Figure 7F:
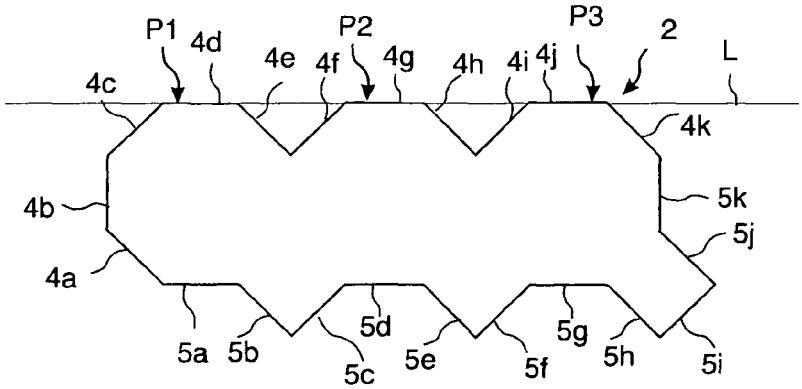

FIGS. 7*c*-7*f* show different embodiments according to the same principles. In FIG. 7*d* nine pairs of adjacent edges (4*a*-4*i* and 5*a*-5*i*) could be connected to each other and two pairs of adjacent edges (4*c*-5*b* and 4*g*-5*f*) could for example be connected with angling. In FIG. 7*f* eleven pairs of adjacent edges (4*a*-4*k* and 5*a*-5*k*) could be connected to each other and there are three protrusions P1, P2, P3 with three pairs of edges (4*d*-5*a*, 4*g*-5*d* and 4*j*-5*g*) which could be connected with for example angling and the other edges could be connected with for example vertical folding.

All embodiments where some edges are installed with angling and some other with vertical folding allow a very simple installation with one angling action only around the outer edges (4*d*, 4*g*, 4*j*) which are positioned along the straight line L as shown in FIG. 7*f*.

As an alternative all edges could be connected with flex tongue systems.

As a non-restrictive example it could be mentioned that the edges preferably could have a length of 80-200 mm.

These embodiments show that the invention makes it possible to connect floor element in a much simpler way and that the shape of the floor panel makes it possible to use other combinations of efficient and simple locking systems than what is possible with traditional locking technology based on individual floor element which are difficult to position and install.

Figure 8A:
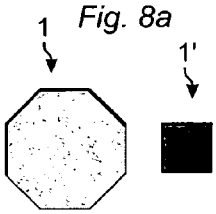
Figure 8B:
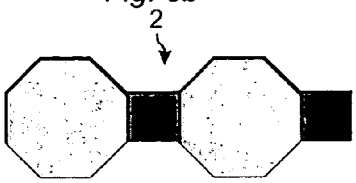
Figure 8C:
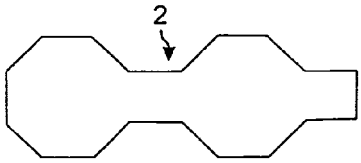
Figure 8D:
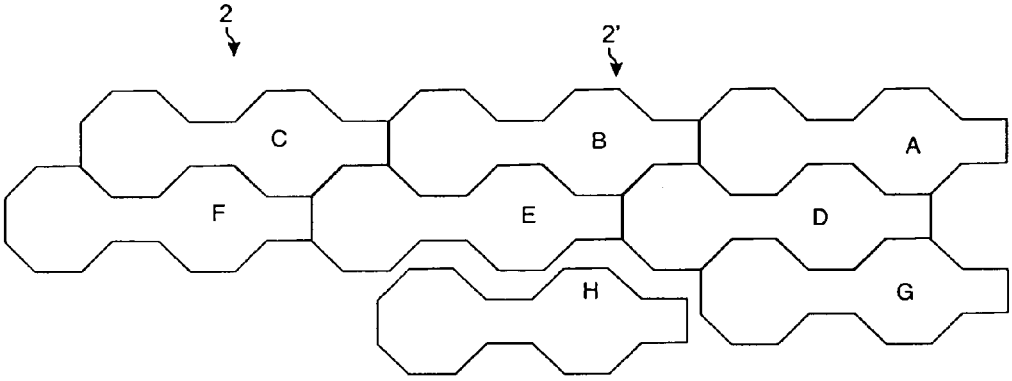
Figure 8E:
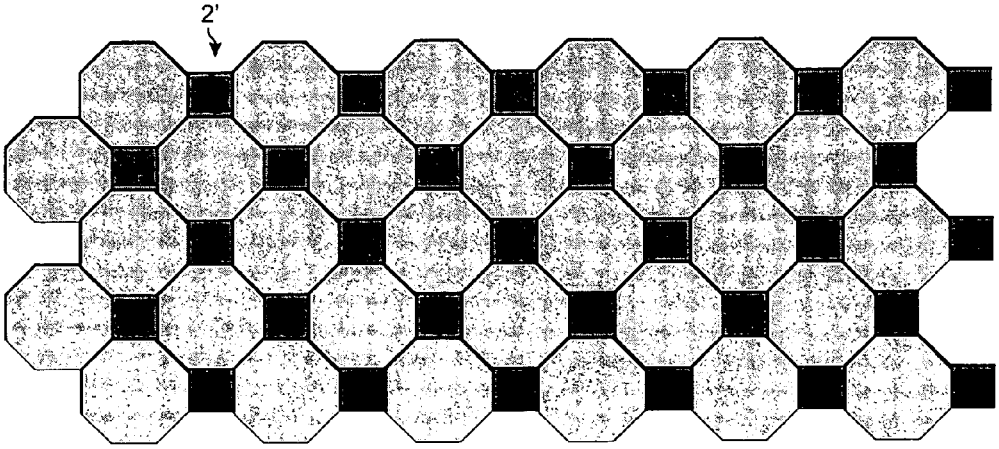
Figure 9A:
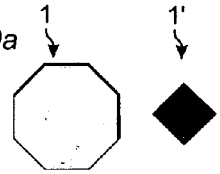
Figure 9B:
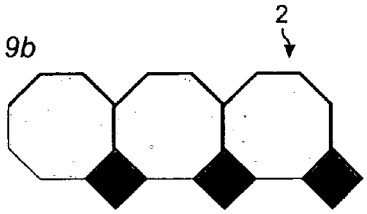
Figure 9C:
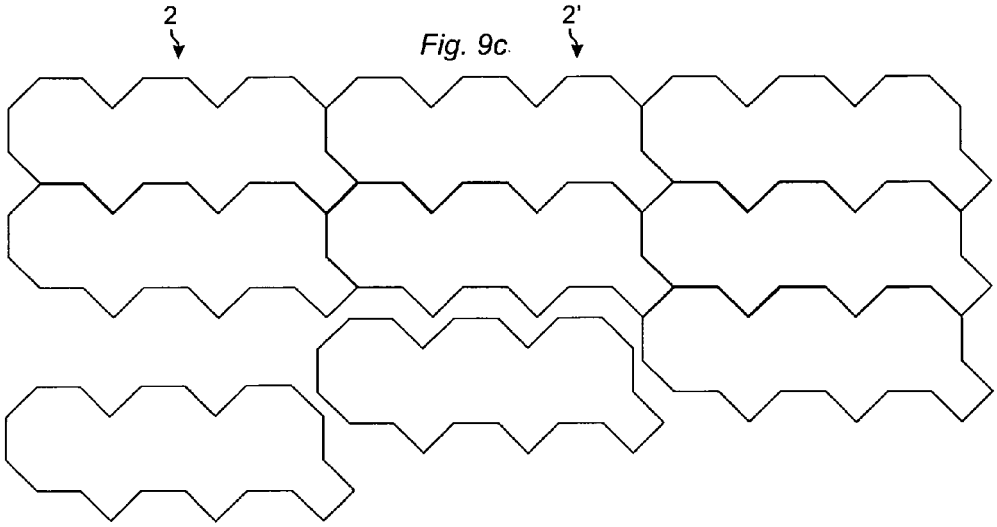
Figure 9D:
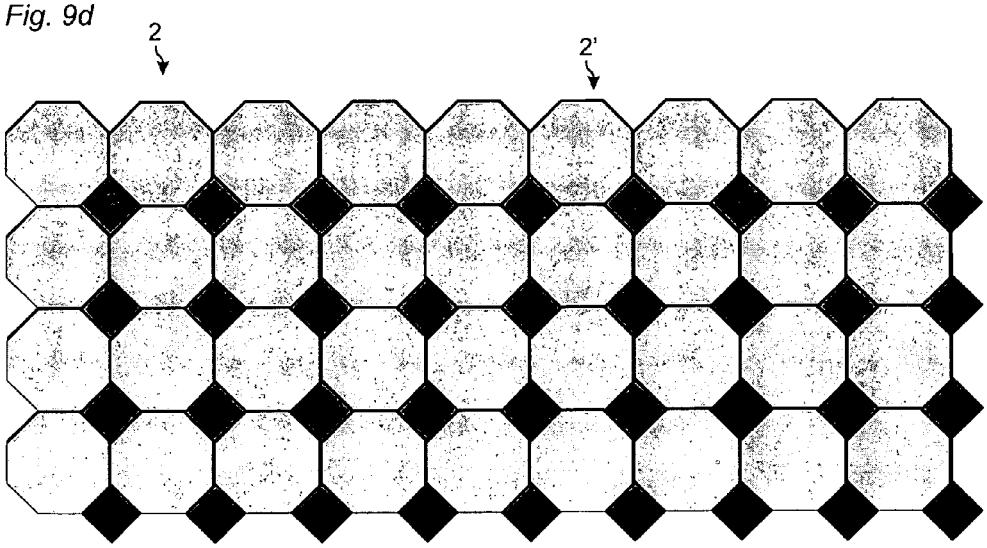

FIGS. 8*a*-8*e* and 9*a*-9*d* show different embodiments. The floor panels according to FIG. 8*d* are installed offset to each other while the floor panels in FIG. 9*d* are installed side by side in parallel rows.

In embodiments with irregular shape, it is not possible to use the traditional angle, displace and snap method. Therefore preferable installation methods are angling only or snapping only or just a vertical displacement.

Embodiments of the invention could be used to connect tile shaped panes installed on a wall or in furniture components.

Although only preferred embodiments are specifically illustrated and described herein, it will be appreciated that many modifications and variations of the present invention are possible in light of the above teachings and within the purview of the appended claims without departing from the spirit and intended scope of the invention.

The invention claimed is:

1. A flooring system comprising a plurality of floor panels, wherein each floor panel comprises at least two floor elements factory connected to each other with a first mechanical locking system, the first mechanical locking system comprises a tongue and groove and glue, wherein the floor panels have a discontinuous core and surface layer, wherein the floor panels are mechanically connectable to each other along at least a first pair of neighboring edges, a first edge of the pair from a first panel being connectable to a second edge of the pair from a second panel, at least one of the floor elements in each floor panel comprises adjacent edges which are angled with respect to each other at an angle of more than 90 degrees in plan view, and a first pair of neighboring edges of the first and second floor panels is provided with a second mechanical locking system adapted to mechanically lock the panels in the horizontal and vertical direction; wherein the second mechanical locking system is a different type than the first mechanical locking system.

2. The flooring system as claimed in claim 1, wherein said floor panel mechanical locking system comprises, on the first pair of neighboring edges of said two floor panels, an angling locking system and a second floor panel locking system comprises, on a second pair of neighboring edges of said two floor panels, a vertical folding locking system.

3. The flooring system as claimed in claim 1, wherein said floor panel mechanical locking system comprises, on the first pair of neighboring edges of said two floor panels, a horizontal snapping locking system and a second floor panel locking system comprises, on a second pair of neighboring edges of said two floor panels, a tongue and groove joint.

4. The flooring system as claimed in claim 1, wherein each floor element comprises at least two pairs of adjacent edges which are angled with an angle of more than 90 degrees in plan view.

5. The flooring system as claimed in claim 1, wherein at least one floor element comprises a surface layer which is a printed layer.

6. The flooring system as claimed in claim 1, wherein at least one of the floor elements comprises a surface layer of laminate.

7. The flooring system as claimed in claim 1, wherein at least one of the floor elements comprises a surface layer of a thermoplastic material or wood.

8. The flooring system as claimed in claim 1, wherein at least two floor elements have a decorative groove on at least one edge and wherein at least two decorative grooves meet each other at an angle other than 90 degrees.

9. The flooring system as claimed in claim 1, wherein each floor panel comprises floor elements of different sizes.

10. The flooring system as claimed in claim 1, wherein each floor panel comprises at least three floor elements and at least two floor elements have six or eight edges.

11. The flooring system as claimed in claim 1, wherein one of the floor elements has eight edges and another has four edges.

12. The flooring system as claimed in claim 1, wherein two panels, in a connected state, are prevented from sliding along each other.

13. The flooring system as claimed in claim 1, wherein each floor panel comprises at least two protrusions with straight edges, which are positioned along a straight line.

14. The flooring system as claimed in claim 1, wherein at least one of the floor elements comprises five to twelve edges.

15. The flooring system as claimed in claim 1, wherein at least one of the floor elements comprises six or eight edges.

16. The flooring system as claimed in claim 1, wherein the surface layer comprises at least two different materials.

17. The flooring system as claimed in claim 16, wherein one of the different materials is wood.

18. The flooring system as claimed in claim 16, wherein one of the materials is a laminate layer.

19. The flooring system as claimed in claim 1, wherein the floor panel mechanical locking system is a horizontal snapping or an angling or a vertical folding locking system.

20. A flooring system comprising a plurality of floor panels, wherein each floor panel comprises adjacent edges being angled with respect to each other at an angle of more than 90 degrees in plan view, wherein a first floor panel is mechanically connectable to one other identical floor panel along both adjacent edges of the first floor panel, wherein the floor panels have a discontinuous core and surface layer, wherein each floor panel comprises at least two floor elements factory connected to each other with a floor element locking system, a first pair of neighboring edges of the first and second floor panels is provided with a floor panel mechanical locking system adapted to mechanically lock the panels wherein the floor element locking system is of a different type than the floor panel mechanical locking system.

21. The flooring system as claimed in claim 20, wherein a first pair of adjacent edges of two floor panels is provided with an angling locking system and a second pair of adjacent edges of said two floor panels provided with a vertical folding locking system.

22. The flooring system as claimed in claim 20, wherein a first pair of adjacent edges of two floor panels is provided with a horizontal snapping locking system and a second pair of adjacent edges of said two floor panels provided with a tongue and groove joint.

23. The flooring system as claimed in claim 20, wherein each floor panel comprises at least two pairs of adjacent edges which are angled with an angle of more than 90 degrees.

24. The flooring system as claimed in claim 20, wherein two panels, in a connected state, are prevented from sliding along each other.

25. The flooring system as claimed in claim 20, wherein each floor panel comprises at least two protrusions with straight edges, which are positioned along a straight line.

26. The flooring system as claimed in claim 20, wherein the floor panel locking system is adapted to mechanically lock the panels in the horizontal and vertical directions.

27. The flooring system as claimed in claim 26, wherein the floor panel locking system is a horizontal snapping or an angling or a vertical folding locking system.

28. The method of claim 27, the floor element locking system mechanically locking only in the vertical direction.

29. The method of claim 27, the floor element locking system being of a type that connects floor elements with a tongue, a groove and glue.

30. The flooring system as claimed in claim 20, wherein at least one of the floor panels has a total of ten edges.

31. The flooring system as claimed in claim 20, wherein at least one of the floor panels has a total of seventeen edges.

32. The flooring system as claimed in claim 20, wherein at least one of the floor panels has a total of eighteen edges.

* * * * *